US005201149A

United States Patent [19]

Eisenblätter

[11] Patent Number: 5,201,149

[45] Date of Patent: Apr. 13, 1993

[54] LAMELLAR END GRINDING TOOL

[75] Inventor: Gerd Eisenblätter, Königsdorf, Fed. Rep. of Germany

[73] Assignee: Gerd Eisenblaetter GmbH, Geretsried, Fed. Rep. of Germany

[21] Appl. No.: 720,162

[22] Filed: Jun. 27, 1991

[30] Foreign Application Priority Data

Jun. 27, 1990 [DE] Fed. Rep. of Germany ..... 4020461

[51] Int. Cl.[5] ..... B24D 13/16

[52] U.S. Cl. ..... 51/394; 51/334; 51/376

[58] Field of Search ..... 51/394, 378, 383, 376, 51/382, 401, 334, 337, 358, 332, 170 T, 206.4, 207

[56] References Cited

U.S. PATENT DOCUMENTS

| | | | |
|---|---|---|---|
| 1,869,564 | 8/1932 | Johnston | 51/170 T |
| 3,616,581 | 11/1971 | Johnson | 51/337 |
| 3,883,998 | 5/1975 | Dosser | 51/376 |
| 4,263,755 | 4/1981 | Globus | 51/358 |
| 4,679,360 | 7/1987 | Eisenblätter | 51/337 |
| 4,718,204 | 1/1988 | Eisenblätter | 51/337 |

FOREIGN PATENT DOCUMENTS

| | | | |
|---|---|---|---|
| 0112405 | 7/1984 | European Pat. Off. | 51/358 |
| 3805719 | 8/1989 | Fed. Rep. of Germany | 51/207 |
| 2626944 | 8/1989 | France | 51/170 T |
| 0114470 | 6/1985 | Japan | 51/334 |
| 0197373 | 10/1985 | Japan | 51/206 R |
| 0016376 | 1/1989 | Japan | 51/132 |
| 0034676 | 2/1989 | Japan | 51/394 |
| 0015979 | 1/1990 | Japan | 51/206.4 |
| 1370846 | 10/1974 | United Kingdom | 51/334 |

*Primary Examiner*—Robert A. Rose
*Attorney, Agent, or Firm*—Keck, Mahin & Cate

[57] ABSTRACT

A lamellar end grinding tool is described, which has a support plate provided with a central mandrel for placing on a driving machine, as well as a grinding wheel detachably fixed thereto. The grinding wheel comprises a carrier, preferably made from a fabric, which has on one side radially oriented grinding flaps overlapping in fan-like manner and fixed by adhesion and is provided on the other side with one surface of a burr surface fastening. The counterpart of the surface fastening is located on the support plate.

27 Claims, 1 Drawing Sheet

LAMELLAR END GRINDING TOOL

BACKGROUND OF THE INVENTION

The invention relates to a lamellar end grinding tool with a support plate, which is provided with a fixing means for mounting on a driving machine, as well as with a grinding wheel, which has a circular disklike carrier detachably fixable to the support plate and radially oriented, fan-like overlapping grinding flaps fixed thereto.

Such a tool is known from U.S. Pat. No. 3,616,581. The support plate has a raised ring provided with a rubber covering. The carrier is provided with radial slots, in which is inserted in each case one grinding flap in such a way that one edge projects on the back surface remote from the grinding side. The carrier is screwed by a central screw onto the support plate and the projecting edges are fixed between the carrier and the ring area for anchoring the grinding flap. Fitting with the grinding flap takes place in situ, in that the carrier is unscrewed, the grinding flaps inserted and subsequently the carrier is again screwed onto the support plate. Therefore the changeover times are relatively long and require considerable care.

In addition, lamellar end grinding wheels are known, which have a plastic plate provided with radial slots and also one equipped with a mandrel and in which the grinding flaps are bonded into the radial slots. If the abrasive becomes worn, the plastic plates form waste which it is difficult to dispose of. Finally, lamellar end grinding wheels with a plate made from reusable aluminium are known, in which the grinding disks are anchored by mechanical jamming in radial slots or are fixed by adhesive to a closed plate surface.

SUMMARY OF THE INVENTION

The object of the invention is to provide a lamellar end grinding tool of the aforementioned type, in which the changeover times are shortened.

This object is achieved in that the connecting means between the carrier and the support plate is constituted by a self-adhesive, detachable, large-area fitted adhesive medium.

According to a preferred development the connecting means is constituted by a layer of a detachable adhesive applied to the carrier side. Up to the time of use this self-adhesive layer can e.g. be covered with a removable protective film.

It is particularly advantageous for the connecting means between the carrier and the support plate to be constituted by a surface or burr fastening. A surface or burr fastening is constituted by two surfaces having different surface effects belonging to a particular slide fastener type. One surface is provided by weaving with e.g. loose warp thread loops of multifilament synthetics. The other surface carries on its top e.g. a plurality of small hooks or alternatively spherical or mushroom heads, which are formed from monofilament burr threads or the like. This leads to a burr-like adhesion action on placing the two strips on one another.

The invention has the advantage that the carrier can be easily removed from the support plate by a movement at right angles to its surface. In spite of this, the plate is securely held during grinding, because the effect of the exclusively occurring shear forces is smaller than that of the surface adhesion action.

According to a preferred development of the invention the carrier is formed from a fabric and the grinding flaps are bonded on. This has the advantage that the plate can be stamped out in an easy manner with little tool wear. In addition, the adhesive forms a good connection with the fabric, so that the grinding flaps are reliably anchored. In addition, due to the flexibility of the carrier, the surface fastening can be more easily detached.

It is fundamentally possible to produce the carrier from hard paper, a metal foil, a plastic film or a fabric of plastic threads. However, it is particularly advantageous for environmental reasons for the fabric to be made from natural fibers. This has the further advantage that it can be treated with an impregnating agent, which improves the adhesive action and connection to the adhesive medium fixing the grinding flaps.

It can also be advantageous for the carrier to comprise several layers, so that the anchoring action, flexibility and fabric openings, particularly with respect to the grain size of the grinding flaps are optimized.

A preferred alternative carrier consists of a buffing wheel or polishing felt.

According to another alternative the carrier consists of a plastic fleece, preferably nylon.

It may be advantageous for extra fine polishing works, that the carrier is densely coated with abrasive grain in that way, that it is dipped into a supply of abrasive grain after it was provided intensively with an adhesive substance.

According to a further alternative the carrier consists of an adhesive grain coated, rubber elastic disk of polyurethane.

The lamellar end grinding tool has a particularly large number of uses as a result of the fact that the external diameter of the carrier and the ring of grinding flaps is larger than the external diameter of the support plate. This produces a projecting or extra length, which also makes it possible to grind in corners and slots. This further development is particularly economic, because after the wearing away of the outer area of the grinding flaps and corresponding external diameter reduction, it is possible to insert a smaller support plate, so that it is possible to wear away the grinding wheel almost completely from the outside to the inside. Through a corresponding choice of the grinding wheel projecting length, it is possible to achieve in planned manner harder or softer grinding. In other words by using one set of support plates of different diameter it is possible to perform both different grinding functions and also to utilize the grinding or abrasive fabric in an optimum manner.

A particularly simple centering of the grinding wheel or the carrier on the support plate is achieved in that the latter and the grinding wheel are in each case provided with a coinciding perforation. If the two perforations are superimposed in aligned manner, e.g. with the aid of a separate pin, then the support plate and grinding wheel are concentric.

Alternatively or additionally thereto, it can be advantageous to make concentric markings on the carrier side facing the support plate and the diameter thereof corresponds to the different support plate diameters, so that the correct seating can be constantly checked.

As an additional securing measure and for easy centering, according to a further development of the invention, it is appropriate to provide the support plate with a central, grinding wheel-side screw bolt or with a tapped hole and a corresponding recess for receiving the counterpart. As the surface fastening retains the grinding wheel and the screw connection essentially merely serves as an additional security to prevent unintentional detachment in the inoperative state, it can be given a corresponding lightweight construction.

A particularly inexpensive manufacture of the grinding wheel is obtained in that the surface belonging to the surface fastening is constituted by loose warp thread loops or a gauze and that the support plate-side part of the surface fastening comprises tentacle adhesives. This further development also has the advantage that the plastic proportion of the grinding wheel can be further reduced.

The invention is described in greater detail hereinafter relative to an embodiment shown in the drawings.

DESCRIPTION OF THE PREFERRED EMBODIMENT

Figure 1:
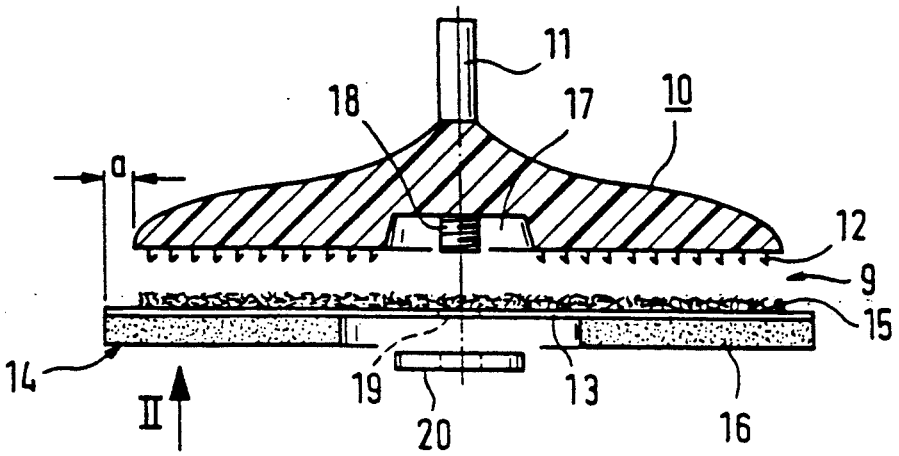
FIG. 1 diagrammatically shows a radial cross-section through a lamellar end grinding tool in an exploded view.

According to FIG. 1 a substantially flexurally stiff support plate 10 with a central mandrel 11 is provided enabling the latter to be inserted in a screw chuck of a not shown driving machine. On the side remote from the mandrel 11 the support plate 10 is provided in large-area form with mushroom-like, elastic plastic tentacles 12, which form a surface of a surface fastening (burr fastening 9).

The opposite surface of the surface fastening 9 is located on a circular disk-like carrier 13 of a seperate grinding wheel 14. This surface is formed by a gauze 15 of loose warp thread loops.

On the other side of the carrier 13 are radially arranged fan-like overlapping grinding flaps 16, so that a grinding flap ring is formed. The grinding disk 16 in each case comprise a fabric with a surface coated with abrasive grain. They are bonded on their faces to the carrier 13.

In the present case the carrier 13 is a natural fibre fabric treated with an impregnating agent to ensure a good connection to the adhesive.

The grinding wheel 14 is inherently flexible, although it is fundamentally possible to use a stiff carrier.

Compared with the external diameter of the support plate 10, the external diameter of the carrier 13 has a predetermined excess or projecting length a, so that the lamellar end grinding tool cannot only be used for large-area grinding, but also enables corners and the like to be worked as a result of the projecting length a.

The support plate 10 is centrally provided with a recess 17 with a central threaded bolt 18, which terminates flush with the surface of the support plate 10. The threaded bolt 18 cooperates with a central perforation 19 in the carrier 13, which ensures a concentric arrangement of support plate 10 and grinding wheel 14.

The carrier 13 or the grinding wheel 14 are fixed to the support plate 10 in that initially the perforation 19 is engaged onto the threaded bolt 18 and subsequently the surfaces of the surface fastening 9 are pressed onto one another. The tentacles 12 then adhere so firmly to the gauze 15 that reliable grinding can take place. As an additional security, it is possible to screw a lock nut 20 onto the threaded bolt 18, the adjacent areas 21 (FIG. 2) of the carrier 13 being jammed in the recess 17. However, generally no such additional securing action is required.

In order to remove the grinding wheel 14, the surface fastening 9 is detached in a simple manner in that the carrier 13 is drawn off axially.

By giving the support plate 10 an appropriate external diameter, it is ensured that the predetermined projecting length a is maintained even after the wearing away of the outer area of the grinding flaps 16. The grinding wheel 14 or the grinding flap 16 can therefore be almost completely worn away from the outside to the inside.

Figure 2:
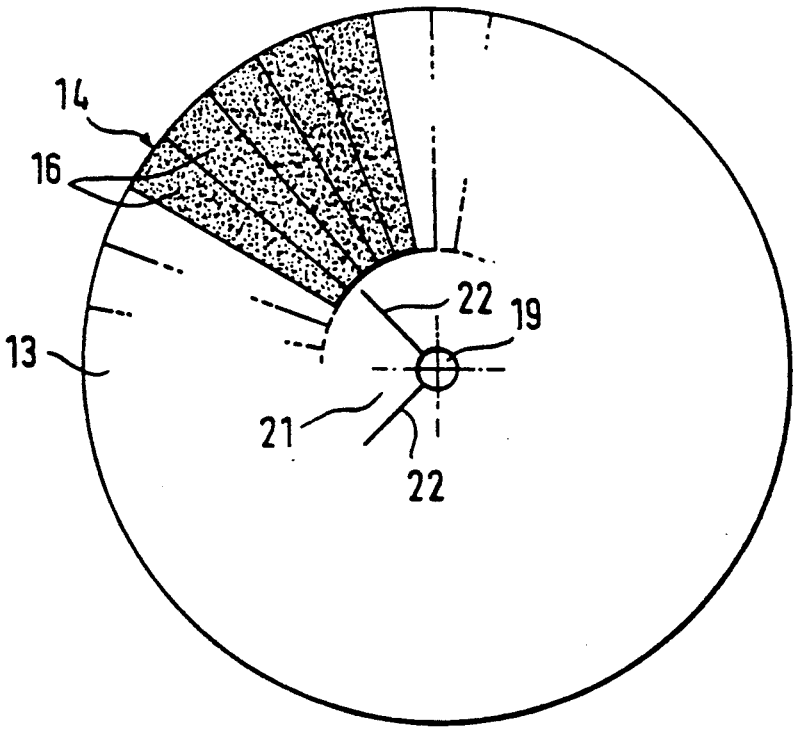
FIG. 2 shows a partial plan view of the lamellar end grinding tool along arrow II in FIG. 1.

As can be gathered from the plan view of FIG. 2, the carrier 13 is provided in the vicinity of the perforation 19 with radial slots 22, so that the area 21 can adapt to the recess 17 of the support plate 10 on locking with the lock nut 20.

What we claim is:

1. A lamellar end grinding tool comprising a support plate provided with a first fastening means for mounting on a driving machine, a grinding wheel having a circular fabric carrier detachably fixable to the support plate and radially oriented grinding flaps partially overlapping one another and fixed thereto, wherein a second fastening means between the carrier and the support plate comprises a self-adhesive, detachable, large-area fitted adhesive medium.

2. A lamellar end grinding tool according to claim 1, wherein the second fastening means between the carrier and the support plate is a carrier-side layer of detachable adhesive.

3. A lamellar end grinding tool according to claim 1, wherein the second fastening means between the carrier and the support plate is a surface fastening.

4. A lamellar end grinding tool according to claim 1, wherein the carrier is formed from a fabric and the grinding flaps are bonded on.

5. A lamellar end grinding tool comprising a support plate provided with a first fastening means for mounting on a driving machine, a grinding wheel having a circular fabric carrier detachably fixable to the support plate and radially oriented grinding flaps partially overlapping one another and fixed thereto, wherein a second fastening means between the carrier and the support plate comprises a self-adhesive, detachable, large-area fitted adhesive medium, wherein the fabric is formed from natural fibers.

6. A lamellar end grinding tool according to claim 1, wherein the carrier comprises several fabric layers.

7. A lamellar end grinding tool according to claim 1, wherein the external diameter of the carrier and the grinding flaps located thereon is larger than the external diameter of the support plate.

8. A lamellar end grinding tool according to claim 1, wherein the support plate and the carrier are in each case provided with a coinciding, central perforation.

9. A lamellar end grinding tool according to claim 1, wherein the support plate is provided with a central, grinding wheel-side pin for a central perforation in the carrier.

10. A lamellar end grinding tool according to claim 9, wherein the support plate is provided with a central, grinding wheel-side threaded bolt.

11. A lamellar end grinding tool according to claim 9, wherein the support plate is provided with a central, grinding wheel-side tapped hole.

12. A lamellar end grinding tool according to claim 3, wherein the surface fastening comprises loose warp thread loops on the carrier and tentacle adhesives on the support plate.

13. A lamellar end grinding tool according to claim 1, wherein said carrier comprises a large-area form with a self-adhesive detachable medium is provided on the side remote from the grinding flaps.

14. A lamellar end grinding tool according to claim 13, wherein a surface of a surface fastening is provided on the side remote from the grinding flaps.

15. A lamellar end grinding tool according to claim 13, wherein the carrier has a layer of a self-adhesive, detachable adhesive on the side remote from the grinding flaps.

16. A lamellar end grinding tool comprising a support plate provided with a first fastening means for mounting on a driving machine, a grinding wheel, comprising a circular carrier detachably fixable to the support plate and abrasives located thereon, the carrier being made from a flexible fabric and a second fastening means between the carrier and the support plate comprising a self-adhesive, detachable, large-area applied surface fastening wherein radially oriented grinding flaps partially overlapping one another are bonded onto the carrier, the external diameter of the carrier and the grinding flaps located thereon is larger than the external diameter of a support plate chosen as a function of the advancing degree of radial wear of the grinding flaps and adapted to the particular degree of radial wear and the support plate is provided with a central, grinding wheel-side pin for a central perforation in the carrier.

17. A lamellar end grinding tool comprising a support plate provided with a first fastening means for placing on a driving machine, a grinding wheel comprising a circular carrier detachably fixable to the support plate and abrasives located thereon, the carrier being made from a flexible fabric and a second fastening means between the carrier and the support plate comprising a self-adhesive, detachable large-area applied adhesive wherein radially oriented grinding flaps partially overlapping one another are bonded onto the carrier, the external diameter of the carrier and the grinding flaps located thereon is larger than the external diameter of a support plate selected as a function of the advancing degree of radial wear of the grinding flaps and which is adapted to the particular degree of radial wear and the support plate is provided with a central, grinding wheel-side pin for a central perforation in the carrier.

18. A lamellar end grinding tool comprising a support plate provided with a first fastening means for mounting on a driving machine and a grinding wheel comprising a circular carrier detachably fixable to the support plate, wherein second fastening means detachably fixing the carrier and the support plate comprises a self-adhesive, detachable, large-area fitted adhesive medium, and the carrier comprises a buffing wheel, and wherein the external diameter of the carrier and the buffing wheel located thereon is larger than the external diameter of a support plate selected as a function of the advancing degree of radial wear of the buffing wheel and is adapted to the particular degree of radial wear and the support plate is provided with a central, grinding wheel-side pin for a central perforation in the carrier.

19. A lamellar end grinding tool comprising a support plate provided with a first fastening means for mounting on a driving machine and a grinding wheel comprising a circular carrier detachably fixable to the support plate, wherein a second fastening means detachably fixing the carrier and the support plate comprises a self-adhesive, detachable, large-area fitted adhesive medium, and the carrier comprises plastic fleece, and wherein the external diameter of the carrier and the plastic fleece located thereon is larger than the external diameter of a support plate selected as a function of the advancing degree of wear of the plastic fleece and which is adapted to the particular degree of wear and the support plate is provided with a central, grinding wheel-side pin for a central perforation in the carrier.

20. A lamellar end grinding tool comprising a support plate provided with a first fastening means for mounting on a driving machine and a grinding wheel comprising a circular carrier detachably fixable to the support plate wherein a second fastening means detachably fixing the carrier and the support plate comprises a self-adhesive, detachable, large-area fitted adhesive medium, and the carrier comprises a surface intensively provided with an adhesive substance and which was dipped into a supply of abrasive grain before setting of the adhesive substance, and wherein the external diameter of the carrier coated with abrasive grain located thereon is larger than the external diameter of a support plate selected as a function of the advancing degree of wear of the abrasive grain coating and which is adapted to the particular degree of wear and the support plate is provided with a central, grinding wheel-side pin for a central perforation in the carrier.

21. A lamellar end grinding tool comprising a support plate having a first fastening means for mounting on a driving machine and a grinding wheel comprising a circular carrier detachably fixable to the support plate wherein a second fastening means between the carrier and the support plate comprises a self-adhesive, detachable, large-area fitted adhesive medium, and the carrier comprises an adhesive grain coated, elastic disk of polyurethane, and wherein the external diameter of the carrier and said disk located thereon is larger than the external diameter of a support plate selected as a function of the advancing degree of wear of said disk and which is adapted to the particular degree of wear and the support plate is provided with a central, grinding wheel-side pin for a central perforation in the carrier.

22. A lamellar end grinding tool according to claim 19, wherein the plastic fleece comprises nylon.

23. A lamellar end grinding tool according to claim 16 wherein the fabric is formed from natural fibres.

24. A lamellar end grinding tool according to claim 16 wherein the carrier comprises several fabric layers.

25. A lamellar end grinding tool according to claim 17 wherein the fabric is formed from natural fibres.

26. A lamellar end grinding tool according to claim 17 wherein the carrier comprises several fabric layers.

27. A lamellar end grinding tool comprising a support plate provided with a first fastening means for mounting on a driving machine, a grinding wheel, comprising a circular carrier detachably fixable to the support plate and abrasives located thereon, the carrier being made from a flexible fabric and a second fastening means between the carrier and the support plate comprising a detachable, large-area applied velcro type hook and loop fastening wherein radially oriented grinding flaps partially overlapping one another are bonded onto the carrier, the external diameter of the carrier and the grinding flaps located thereon is larger than the external diameter of a support plate chosen as a function of the advancing degree of wear of the grinding flaps and adapted to the particular degree of wear and the support plate is provided with a central, grinding wheel-side pin for a central perforation in the carrier.

* * * * *